US009810028B2

(12) United States Patent
Minosyan et al.

(10) Patent No.: US 9,810,028 B2
(45) Date of Patent: Nov. 7, 2017

(54) EM GAP SUB ASSEMBLY

(71) Applicant: NABORS DRILLING TECHNOLOGIES USA, INC., Houston, TX (US)

(72) Inventors: Vadim Minosyan, Conroe, TX (US); Peter Harvey, Tampa, FL (US)

(73) Assignee: Canrig Drilling Technology Ltd., Houston, TX (US)

( * ) Notice: Subject to any disclaimer, the term of this patent is extended or adjusted under 35 U.S.C. 154(b) by 446 days.

(21) Appl. No.: 14/605,445

(22) Filed: Jan. 26, 2015

(65) Prior Publication Data

US 2015/0211307 A1 Jul. 30, 2015

Related U.S. Application Data

(60) Provisional application No. 61/931,901, filed on Jan. 27, 2014.

(51) Int. Cl.
*E21B 17/00* (2006.01)
*E21B 17/02* (2006.01)
(Continued)

(52) U.S. Cl.
CPC ..... *E21B 17/003* (2013.01); *E21B 17/028* (2013.01); *E21B 17/042* (2013.01); *E21B 47/122* (2013.01)

(58) Field of Classification Search
CPC ..... E21B 17/003; E21B 17/028
See application file for complete search history.

(56) References Cited

U.S. PATENT DOCUMENTS 4,496,174 A 1/1985 McDonald et al.
4,997,048 A * 3/1991 Isom ..... E21B 17/003 166/57
(Continued)

FOREIGN PATENT DOCUMENTS

WO 2009086637 A1 7/2009

OTHER PUBLICATIONS

International Search Report for Application No. PCT/US2015/012893, filed Jan. 26, 2015, dated May 7, 2015, 1 page.

*Primary Examiner* — Giovanna C. Wright
(74) *Attorney, Agent, or Firm* — Enrique Abarca; Abel Law Group, LLP

(57) ABSTRACT

An improved gap sub assembly that can withstand the rigors of directional drilling, while still being cost effective and easy to deploy at the drill site. Embodiments can be assembled by sliding a mandrel into a housing without any threading or clocking, filling the gap between the housing and mandrel with an electrically isolating material, and curing the electrically isolating material to mechanically couple the housing and mandrel. In some embodiments, the interior surface of the housing and the outer surface of the mandrel comprise a plurality of complimentary axial sections having staggered diameters so that a constant dielectric gap is maintained. In some embodiments, the interior surface of the housing and the outer surface of the mandrel comprise non-overlapping right- and/or left-handed helical grooves that, when filled with a cured electrically insulating material, forms a complex 3D shear resistance mechanism optimized to resist torsion or twisting.

20 Claims, 12 Drawing Sheets

(51) Int. Cl.
*E21B 17/042* (2006.01)
*E21B 47/12* (2012.01)

(56) References Cited

U.S. PATENT DOCUMENTS

| | | | | |
|---|---|---|---|---|
| 7,252,160 | B2 | 8/2007 | Dopf et al. | |
| 7,900,968 | B2 | 3/2011 | Camwell et al. | |
| 2002/0113432 | A1 | 8/2002 | Dopf et al. | |
| 2004/0163822 | A1 | 8/2004 | Zhang et al. | |
| 2006/0220650 | A1 | 10/2006 | Lovell et al. | |
| 2008/0191900 | A1* | 8/2008 | Camwell | E21B 17/028 340/854.3 |
| 2013/0319767 | A1 | 12/2013 | Wilson et al. | |
| 2015/0292274 | A1* | 10/2015 | Logan | E21B 17/003 166/380 |

* cited by examiner

FIG. 2C
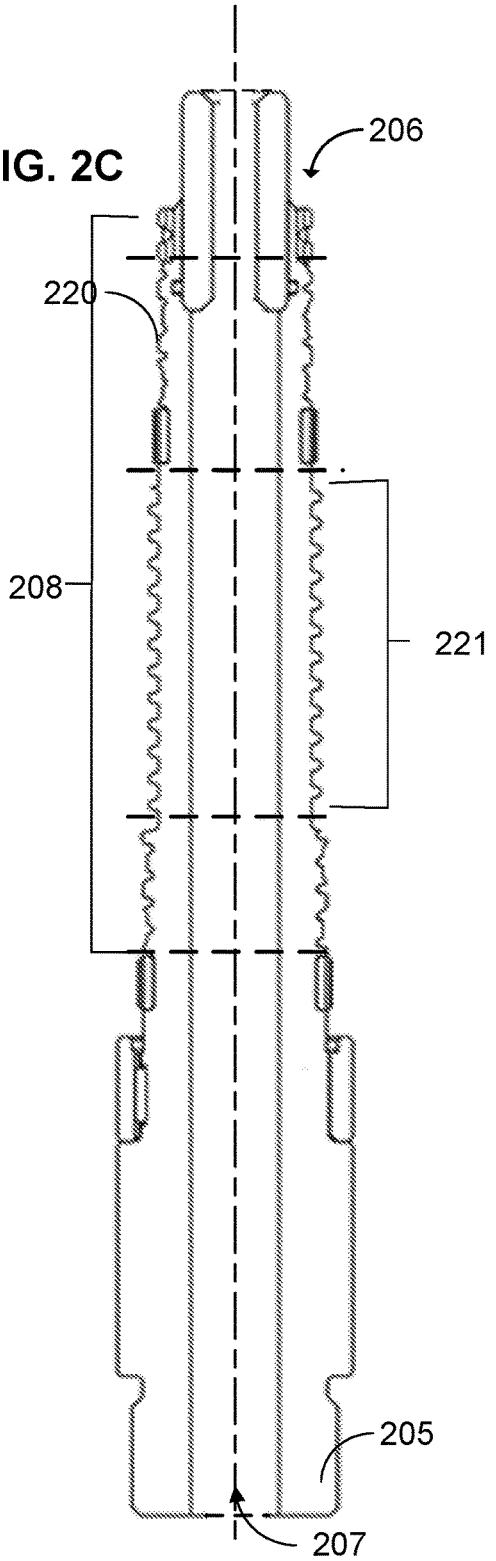
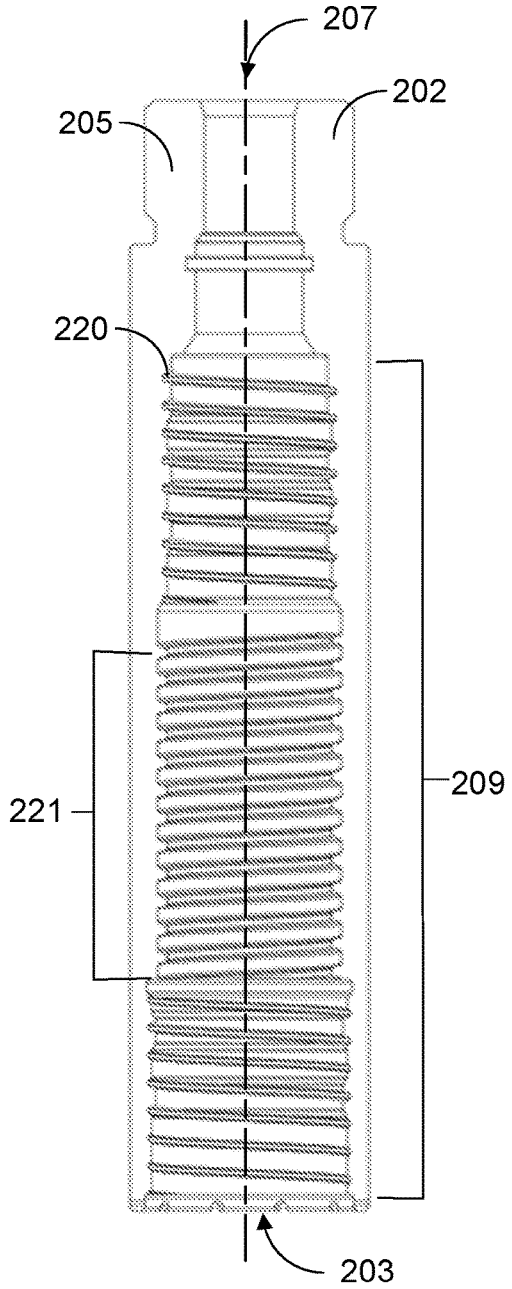
FIG. 2D

FIG. 5A
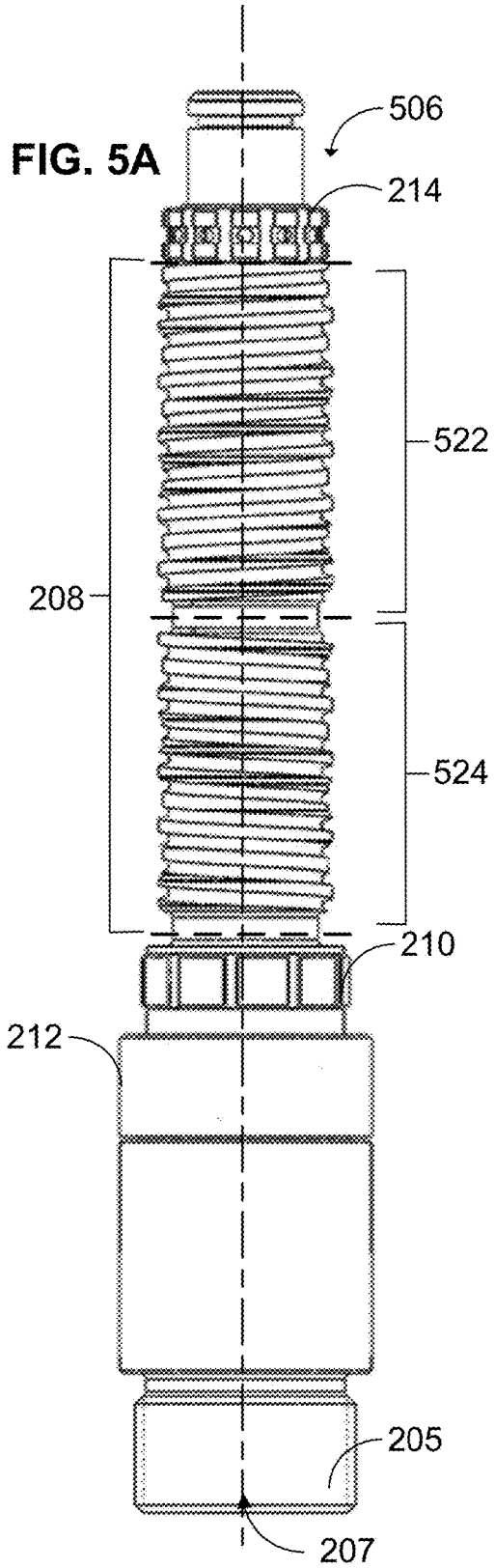
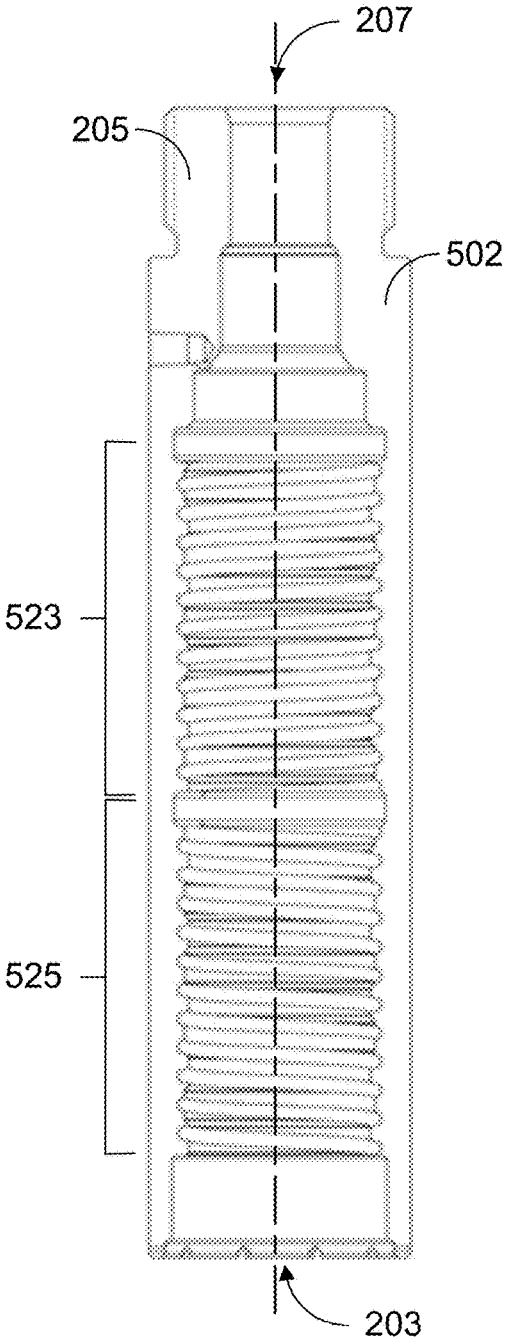
FIG. 5B

EM GAP SUB ASSEMBLY

CROSS-REFERENCE TO RELATED APPLICATION(S)

This application claims priority under 35 U.S.C. §119(e) to U.S. Patent Application No. 61/931,901, entitled "EM Gap Sub Assembly," by Vadim Minosyan and Peter Harvey, filed Jan. 27, 2014, which is assigned to the current assignee hereof and incorporated herein by reference in its entirety.

FIELD OF THE DISCLOSURE

The present disclosure is directed to an electrically isolating gap sub assembly, particularly a gap sub assembly for use in EM telemetry for directional drilling applications.

BACKGROUND

To obtain hydrocarbons such as oil and gas, boreholes are drilled by rotating a drill bit attached to a drill string. The drill bit is typically mounted on the lower end of the drill string as part of a bottom-hole assembly (BHA) and is rotated by rotating the drill string at the surface and/or by actuation of down-hole motors or turbines. A variety of sensors employed in the drill string are used to monitor various down-hole conditions, such as pressure, spatial orientation, temperature, gamma ray count, etc., that are encountered while drilling. The use of sensors during the drilling operation to provide information related to positioning or steering the drill, such as direction, orientation, gamma, and drill bit information, is referred to as "Measurement While Drilling" (MWD). The phrase "Logging While Drilling" (LWD) is often used to using sensors for petrophysical or geological measurements during drilling. As used herein, "MWD" will also be used to encompass LWD applications unless otherwise specified. Regardless of whether MWD or LWD sensors are used, in order for the drilling to benefit from "real-time" information, sensor data (either raw or processed) must be transmitted to the surface, typically from deep underground.

Although a variety of transmission methods are known, one of the most common is referred to as electromagnetic (EM) telemetry. A down-hole EM transmitter is used to create very low frequency EM carrier waves, which are modulated in order to carry information (such as sensor data). These low-frequency waves will travel through the earth surrounding the borehole to the surface where the signal can be detected, typically by measuring the induced electric potential difference between the drill rig and a grounding rod located in the earth some distance away. These signals are received by a receiver at the surface and deciphered by a control circuit or processor.

Specifically, the EM carrier waves are generated by applying an alternating electric current across an electrically isolated (nonconductive) portion of the drill string referred to as the "gap sub." This allows the upper and lower portions of the drill string (electrically isolated from each other by the gap sub) to function as a dipole antenna so that an alternating current applied to the two isolated portions of the drill string results in the generation of an EM carrier wave, which can be modulated to transmit digital information.

Generally, the gap sub assembly must electrically insulate the upper and lower sections of the drill string and yet be structurally capable of carrying high torsional, tensile, compressive, and bending loads. This is especially true for directional drilling where the drill string, and in particular the sub gap connector, is typically subjected to extreme torsional, compression, tension, and bending forces. Such extreme forces can result in gap sub connection failure, usually at the weakest point in the subassembly.

Although a number of different gap subs are known in the prior art, there still exists a need for a gap sub assembly that can withstand the rigors of directional drilling applications, while still being cost effective to manufacture and easy to deploy at the drill site.

BRIEF DESCRIPTION OF THE DRAWINGS

The present disclosure may be better understood, and its numerous features and advantages made apparent to those skilled in the art by referencing the accompanying drawings.

FIG. 2C is a side sectional view of the mandrel of the gap sub of FIG. 2A.

FIG. 2D is a side sectional view of the housing of the gap sub of FIG. 2A.

FIG. 5A is a side view of another embodiment of a gap sub mandrel having right- and left-handed helical grooves in different sections of the connection surface.

FIG. 5B is a side view of another embodiment of a gap sub housing having right- and left-handed helical grooves in different sections of the connection surface in which the housing is shown as transparent.

The accompanying drawings are not intended to be drawn to scale. In the drawings, each identical or nearly identical component that is illustrated in various figures is represented by a like numeral. For purposes of clarity, not every component may be labeled in every drawing.

DESCRIPTION OF THE DRAWINGS

Embodiments of the present invention provide an improved gap sub assembly that can withstand the rigors of directional drilling applications, while still being cost effective to manufacture and easy to deploy at the drill site. This is accomplished through the use of a novel combination of features that produce good resistance to both axial and torsional stress.

Figure 1:
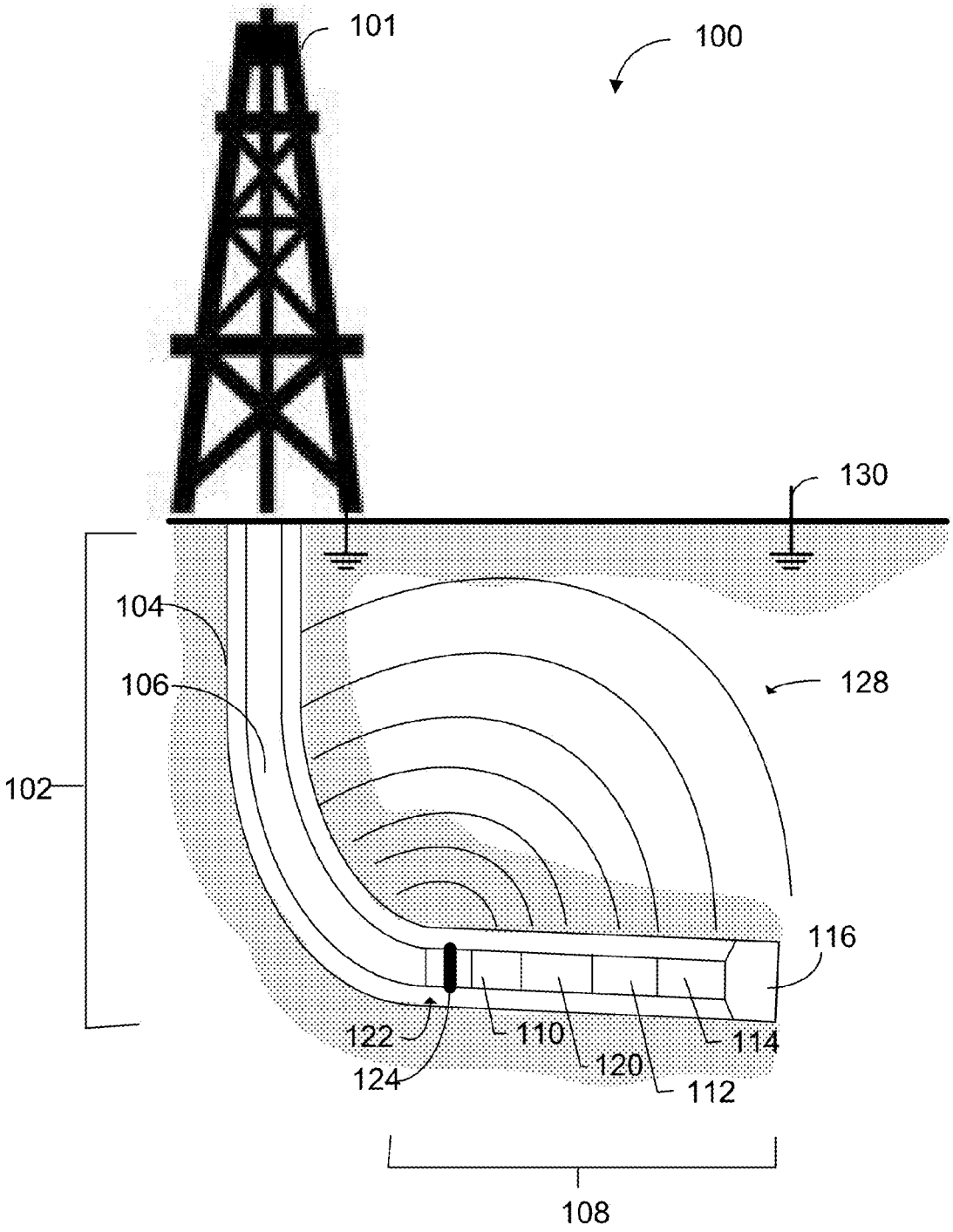
FIG. 1 is a schematic drawing of a prior art drilling system using EM telemetry.

FIG. 1 is a simplified schematic illustration of a drilling system 100 using EM telemetry to transmit LWD/MWD data to the surface. A derrick 101 supports and rotates the drill string 102 in order to actually drill the well. The drill string 102, which is suspended within the borehole 104 once drilling is commenced, comprises a number of tubular sections connected together, with a drill bit 116 attached at the bottom of the drill string. The lowest part of the drill string, extending from the drill bit to the drill pipe, is referred to as the bottom-hole assembly ("BHA") 108. As used herein, terms such as "top," "up," "upper," "upwardly," or "upstream" will mean toward the surface of the well and terms such as "bottom," "down," "lower," "downwardly," or "downstream" will mean toward the terminal end of the well, regardless of the well-bore orientation. Also, the terms well, wellbore, and borehole are used herein as synonyms.

A typical BHA can include the drill bit, a mud motor, a BHA sensor assembly (including MWSD and LWD components), various connectors and subs, and a number of heavy weight drill collars (pipes) used to apply weight to the bit. The length of a conventional BHA assembly, including the number of heavy collars, can be from about 200 to about 400 feet.

The BHA of FIG. 1 also includes an EM telemetry system 120 that processes signals from sensors and transmits data to the surface. The EM telemetry system 120 can be coupled to a drill collar at its upper end and to the sensors and drilling systems of the BHA at its lower end. The EM telemetry system 120 includes an electrically insulating connector, referred to as a gap sub 122, that insulates the upper part of the drill string (above the gap sub) from the lower portion of the drill string (below the gap sub) to form a dipole antenna. An EM transmitter and associated electronics (not shown) gather and encode the data from the various sensors onto an EM carrier wave 128 electrically produced across the electrical break 124 caused by the gap sub disposed between the upper and lower sections of the drill string. The EM carrier wave travels through the earth, allowing a potential difference to be measured between the derrick 101 and a surface antenna 130 located some distance away. The EM carrier wave can then be amplified and decoded to reproduce the data from the BHA sensors.

The gap sub assembly must be able to electrically insulate the upper and lower sections of the drill string, which is typically accomplished by the use of nonconductive or dielectric materials. Unfortunately, such materials tend to have much less strength and ductility than the conductive metal materials used to form the drill pipe. Prior art gap subs make use of a variety of complicated designs to produce a structure capable of withstanding the stresses encountered in the drilling process. As a result, known gap subs are typically expensive and very difficult to manufacture/assemble.

A gap sub according to embodiments of the present invention can withstand the rigors of directional drilling applications, while still being cost effective to manufacture and easy to deploy at the drill site. In particular embodiments, the gap sub is especially easy to manufacture and assemble because the upper and lower components of the gap sub can be assembled merely by sliding a generally cylindrical mandrel into a generally cylindrical housing, without any threading or clocking (turning the components to a particular orientation). Also in particular embodiments, the electrical insulation is provided by an electrically isolating medium that can be injected into the spaces between the upper and lower components and cured. Because an electrically isolating medium in embodiments described herein also serves to mechanically hold the housing and mandrel together, the electrically isolating medium can also be referred to as a bonding material. As described in greater detail below, suitable electrically isolating media/bonding materials include some types of epoxy and injectable plastics. In some embodiments, the electrically isolating medium (such as epoxy) is not injected into the fill space at high pressure and does not require exposure to high temperatures in order to cure.

Figure 2A:
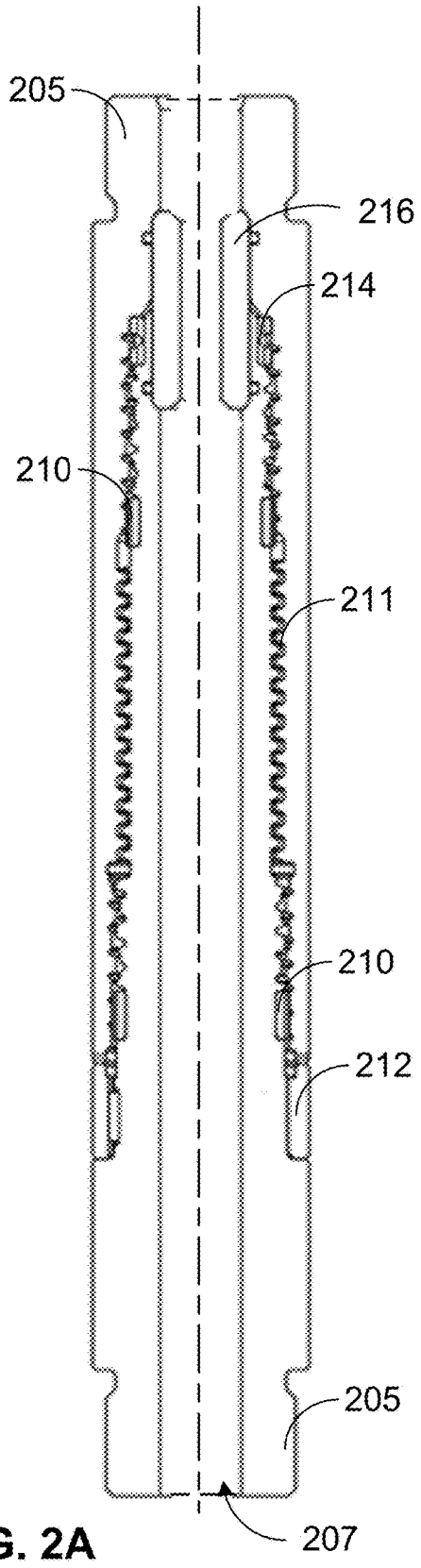
FIG. 2A is a side sectional view of an assembled gap sub according to an embodiment of the present invention.
Figure 2B:
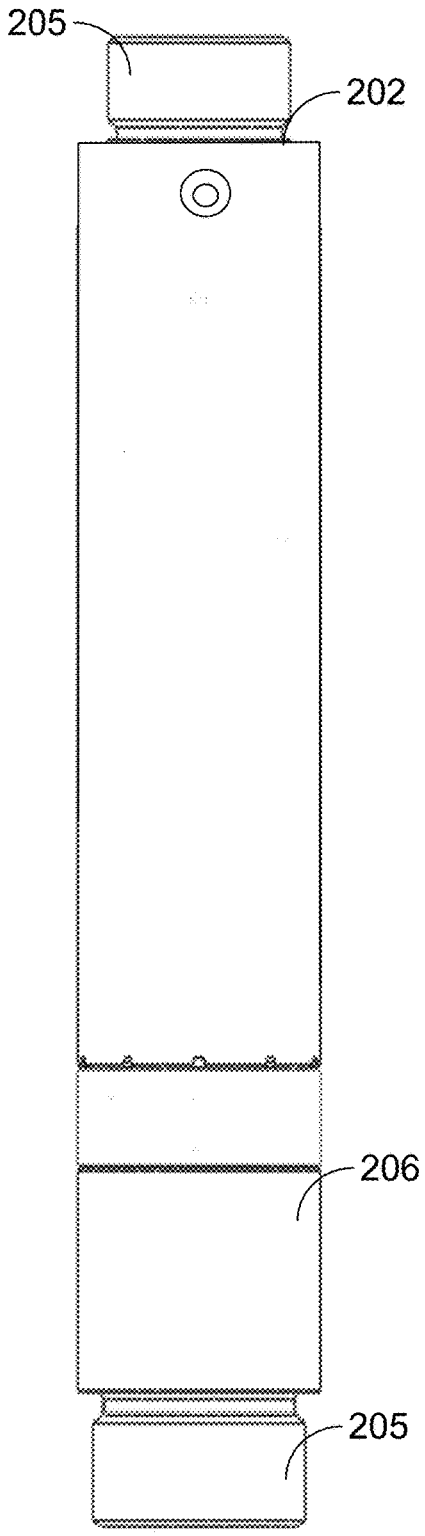
FIG. 2B is a side view of an assembled gap sub according to an embodiment of the present invention.

FIG. 2A is a side sectional view of an assembled gap sub according to an embodiment of the present invention, while FIG. 2B is a side view of such an assembled gap sub. FIG. 2C shows a side sectional view of the mandrel and FIG. 2B shows a side sectional view of the housing of the gap sub of FIG. 2A. The assembled gap sub generally comprises a generally cylindrical mandrel 206 inserted into a correspondingly shaped housing 202. Housing 202 has an open end 203 and an interior connecting portion 209 proximal to the open end. Mandrel 206, is also generally cylindrical in shape, and has a connecting portion 208 at one end, wherein the open end 203 of the cylindrical housing 202 is configured to receive the connecting portion 208 of the cylindrical mandrel 206. End connections 205 at the upper end of the housing and the lower end of the mandrel allow the gap sub to be connected to drill collars or other components in the BHA assembly. Both the mandrel and the housing are generally cylindrical in shape and when connected together the assembled gap sub has a central flow bore 207 so that drilling mud can pass longitudinally through the center bore and down through the remainder of the BHA, Preferably the mandrel 206 is sized so that the connecting portion 208 of the mandrel can be inserted into the interior of a connecting portion 209 of the cylindrical housing 202 to form a generally uniform space or dielectric gap 211 between the interior surface of the connecting portion of the housing and the outer surface of the connecting portion of the mandrel. In particular embodiments, the mandrel and housing are formed from a high-strength, non-magnetic material such as an austenitic stainless steel.

External spacer 212 and internal spacer 216 are formed from a non-conductive material such as fiberglass and serve to maintain the dielectric gap between the mandrel and the housing. Upper and lower bearings 210 maintain the radial positioning of the mandrel and housing, while bearing 214 maintains the proper axial positioning. In some embodiments, bearings 210 can be formed from a non-conductive polymer such as PEEK, while bearing 214 can be formed from a ceramic material.

A variety of different connecting surfaces 220 can be used according to the embodiments described herein. For example, the gap sub of FIGS. 2A to 2D uses a typical, overlapping, right-handed threading in the center portion 221 of the connecting regions of the housing and mandrel. Embodiments may also make use of a novel arrangement of non-overlapping right and left handed helical grooves formed over regions of staggered axial sections, as discussed in greater detail below.

Figure 3A:
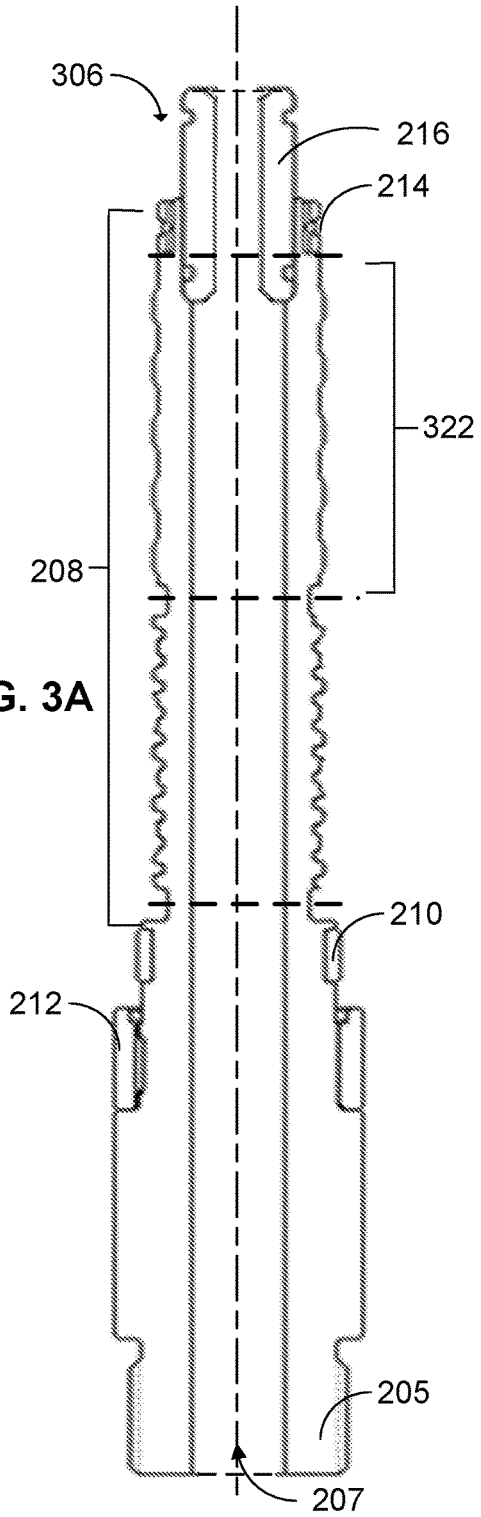
FIG. 3A is a side sectional view of the mandrel of a gap sub according to an embodiment of the present invention.
Figure 3B:
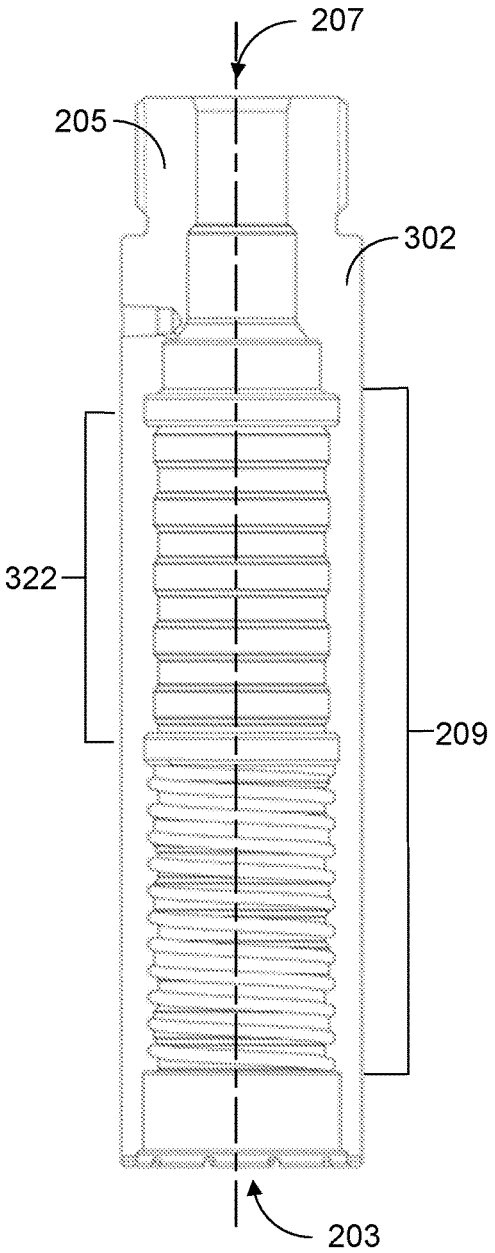
FIG. 3B is a side sectional view of the housing of a gap sub according to an embodiment of the present invention.
Figure 3C:
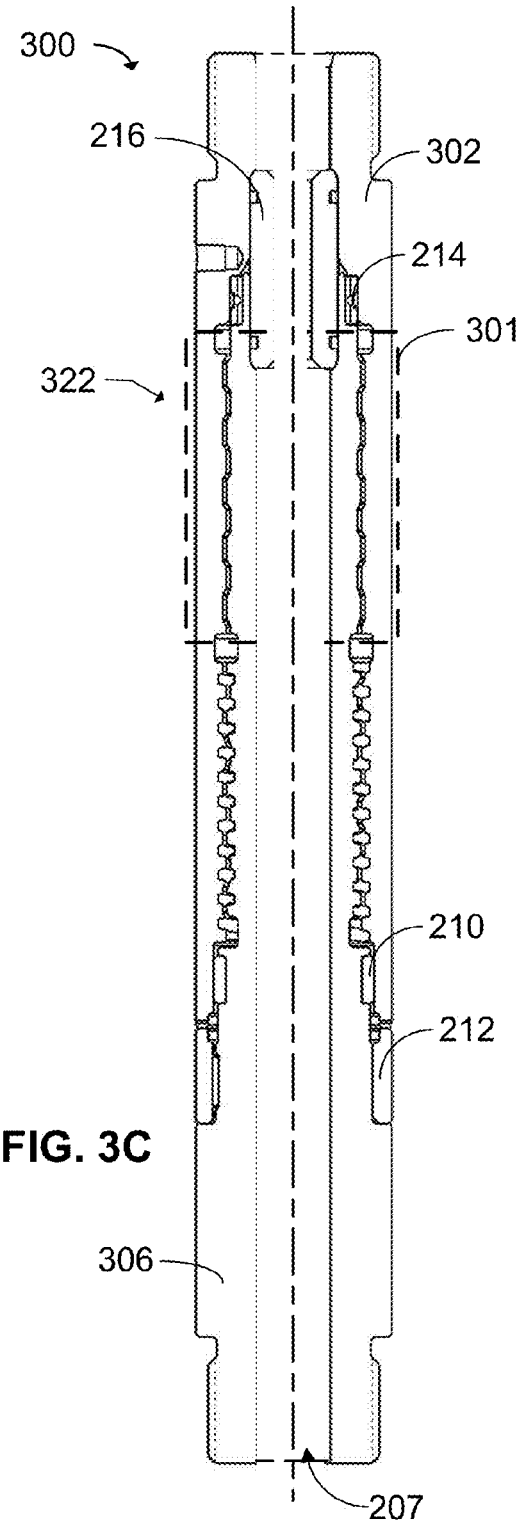
FIG. 3C is a side sectional view of the mandrel of FIG. 3A inserted into the housing of FIG. 3B to form an assembled gap sub.
Figure 3D:
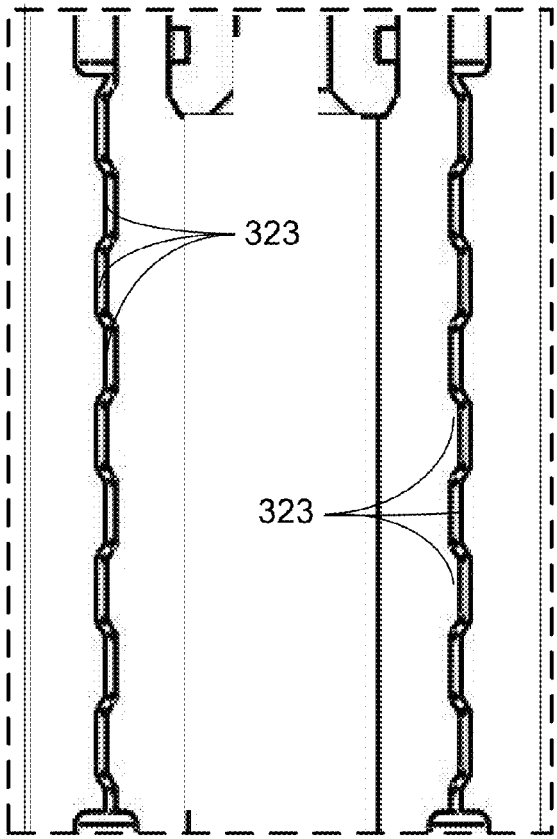
FIG. 3D shows an enlarged view of a portion of the side sectional view of the gap sub of FIG. 3C.

FIGS. 3A to 3D show another gap sub according to a particular embodiment of the present invention. FIG. 3A is a side sectional view of the mandrel 306 of a gap sub according to an embodiment of the present invention, and FIG. 3B is a side sectional view of a corresponding housing 302. FIG. 3C is a side sectional view of the mandrel of FIG. 3A inserted into the housing of FIG. 3B to form an assembled gap sub 300. FIG. 3B shows an enlarged view of the portion of FIG. 3A inside box 301.

Figure 4A:
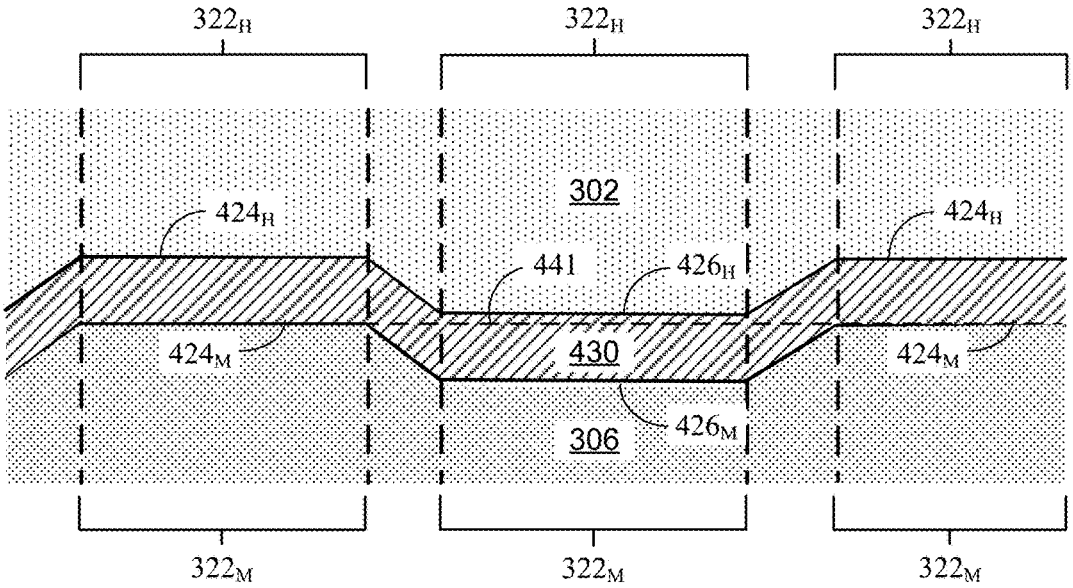
FIGS. 4A-4B show a schematic representation of axial sections of the gap sub components having staggered diameters according to embodiments of the present invention.
Figure 4B:
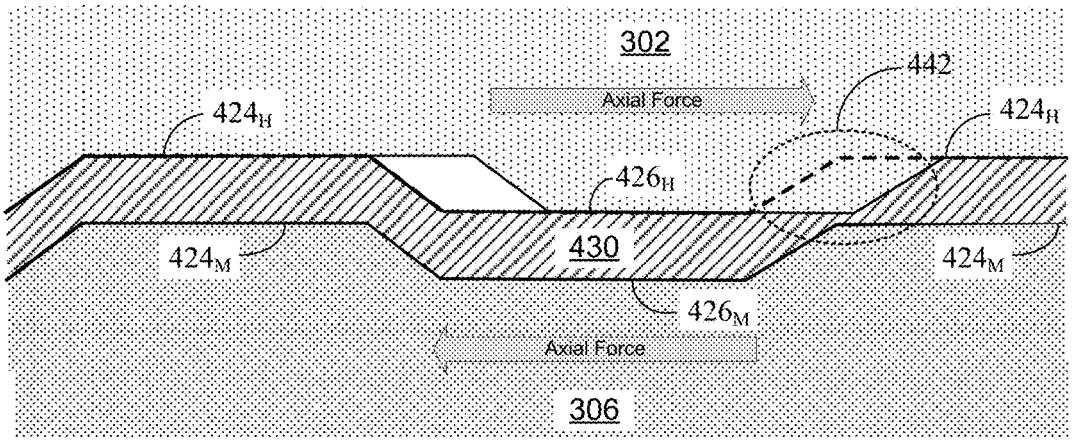

Referring also to FIGS. 4A and 4B, the interior surface of the housing connecting portion 302 includes a region 322 comprising a plurality of axial sections $\mathbf{322}_H$ having a staggered internal diameter in which at least one axial section having a first internal diameter is adjacent to axial sections on either side which have larger internal diameters. The outer surface of the connecting portion of the mandrel 306 also includes a region comprising a plurality of axial sections $\mathbf{322}_M$ having a staggered diameter in which at least one axial section having a first diameter is adjacent to axial sections on either side which have larger diameters. Preferably, the two connecting portions have "complimentary" surfaces, meaning the surfaces of the two components fit together so that the axial sections having staggered diameters on the interior surface of the housing match up with the axial sections having staggered diameters on the outer surface of the mandrel. As a result, the space between the housing and the mandrel remains substantially uniform for all of the axial sections; thus maintaining a consistent dielectric gap.

A particular embodiment is illustrated in FIGS. 4A and 4B, which show a schematic representation of a portion of one possible arrangement of such staggered axial sections. In the embodiment of FIGS. 4A and 4B, a bonding material 430, such as an epoxy, has been injected into the space (gap) between the housing 302 and the mandrel 306. The connection surfaces on the interior of the housing and the exterior surface of the mandrel are divided into a number of different axial sections $\mathbf{322}_H$, $\mathbf{322}_M$.

As described above, adjacent axial sections 322 have staggered diameters. Thus, axial sections $\mathbf{424}_H$ (on the interior surface of the housing) have a different diameter than adjacent axial sections $\mathbf{426}_H$, while axial sections $\mathbf{424}_M$ (on the exterior surface of the mandrel) have a different diameter than adjacent axial sections $\mathbf{426}_M$. In the particular embodiment of FIGS. 4A and 4B, at least one housing axial section $\mathbf{426}_H$ having a first diameter is adjacent to axial sections $\mathbf{424}_H$ on either side which have smaller diameters, while at least on mandrel axial section $\mathbf{426}_M$ having second diameter is adjacent to axial sections on either side which have larger diameters.

Also as described above, the axial sections on the housing and the axial sections on the mandrel are non-overlapping, as can be seen by comparing line 441, which illustrates that there is a small gap between the largest diameter the mandrel (axial section $\mathbf{424}_M$) with the smallest internal diameter of the housing 302 (section $\mathbf{426}_H$). As used herein, "non-overlapping" means that there is at least some amount of clearance between the inner diameter of the housing and the outer diameter of the mandrel so that the mandrel can be inserted axially into the housing without rotating or twisting either of the components.

In particular embodiments, the staggered arrangement of the axial sections results in at least one axial section on the housing having a first internal diameter being adjacent to axial sections on either side which have smaller internal diameters and/or at least one axial section on the inner surface of the mandrel having a second diameter being adjacent to axial sections on either side which have larger diameters. As a result, once the components are assembled and the insulating bonding material has been added and cured, the mandrel cannot be removed from the housing by way of an axial force without shearing through at least one layer of the cured bonding material.

As shown in FIG. 4B, if the mandrel were to be removed from the housing by the application of axial force (in the directions shown by the arrows) the cured epoxy (or other electrically isolating medium) would be forced to shear in the area within circle 442, rather than just delaminate from the connecting surfaces. The shear resistance of a bonding material such as a hardened epoxy or other electrically isolating material will be significantly greater than the resistance to delamination from the connecting surfaces of the housing and mandrel. As a result, the staggered axial sections of this embodiment (when the insulating bonding material has be added and cured) will provide much greater resistance to axial force (pushing and pulling) than if such staggered axial sections were not used.

In addition to resistance of axial (push-pull) force, particular embodiments also include features designed to withstand twisting or torsional force. For example, when the BHA including a gap sub is connected to other drill pipe sections, both the BHA and the drill pipe sections are subjected to torque (commonly referred to as make-up torque). Conventional gap subs typically have an installation requirement that no make-up torque be transmitted across the gap. Unfortunately, this recommendation is often not followed at the rig. An assembled gap sub according to embodiments described herein can withstand a torsional force that is at least equal to the make-up torque. Thus, in certain embodiments, the assembled gap sub can withstand a torsional force that is at least about 10,000 lb-ft, at least about 16,000 lb-ft, at least about 20,000 lb-ft, at least about 23,000 lb-ft, or even at least about 30,000 lb-ft without failure. In other embodiments, the assembled gap sub can withstand a torsional force that is at least equal to about two times the make-up torque, about four times the make-up torque, or even at least eight times the make-up torque. Thus, in some other embodiments, the assembled gap sub can withstand a torsional force that is at least about 40,000 lb-ft, at least about 60,000 lb-ft, or even at least about 80,000 lb-ft without failure.

Figure 5C:
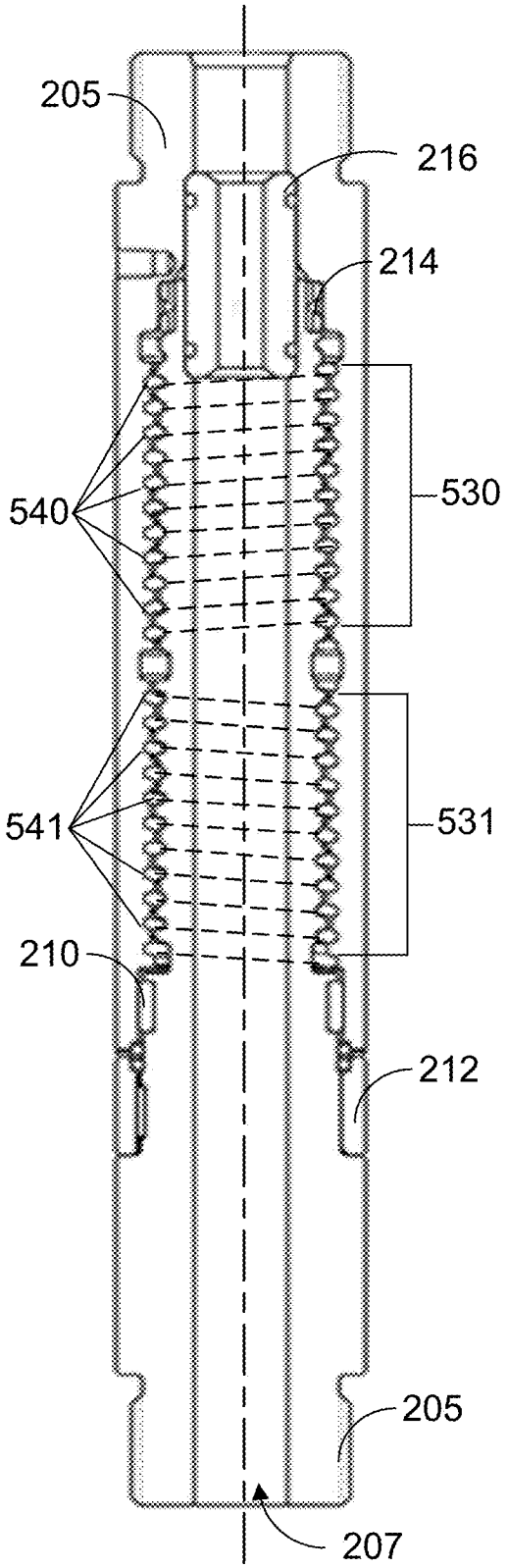
FIG. 5C is a side sectional view of the mandrel of FIG. 5A inserted into the housing of FIG. 5B to form an assembled gap sub.

For example, in some embodiments, the connecting surfaces of both the housing and mandrel also include at least one complimentary section having right-handed helical grooves. In particular embodiments, the connecting surfaces of both the housing and mandrel also include at least one complimentary section having left-handed helical grooves. Such an embodiment is illustrated in FIGS. 5A to 5C. FIG. 5A is a side view of a gap sub mandrel 506 having an upper section 522 of the connection surface having right-handed helical grooves and a lower section 524 having left-handed helical grooves. FIG. 5B is a side view of complimentary gap sub housing an upper housing section 523 of the connection surface having right-handed helical grooves and a lower housing section 524 having left-handed helical grooves. FIG. 5C is a side sectional view of the mandrel of FIG. 5A inserted into the housing of FIG. 5B to form an assembled gap sub.

FIG. 5C shows a longitudinal side-sectional view of a gap sub 500 having a mandrel 502 inserted inside a housing 506. The connection surfaces of both the housing and the mandrel include a first section 530, in which right-handed helical grooves 540 can be formed on the inner surface of the housing and the outer surface of the mandrel. The connection surfaces of both the housing and the mandrel also include a second section 531, in which left-handed helical grooves 541 are formed on the inner surface of the housing and the outer surface of the mandrel. In the embodiment of FIGS. 5A to 5C, these helical grooves are non-overlapping. In other words, as discussed in greater detail below, there is at least some amount of clearance between the smallest inner diameter of the grooved portion of the housing and the largest outer diameter of the grooved portion of the mandrel so that the mandrel can be inserted axially into the housing without rotating or twisting either of the components.

In some embodiments, the helical grooves (right and/or left handed) may be used instead of the staggered axial sections described above. In other embodiments, the helical grooves are used in addition to staggered axial sections and can be formed in one or more separate regions of the connecting portions of the housing and mandrel or superimposed onto the staggered axial sections to have both types of connecting features working in the same space.

Figure 6A:
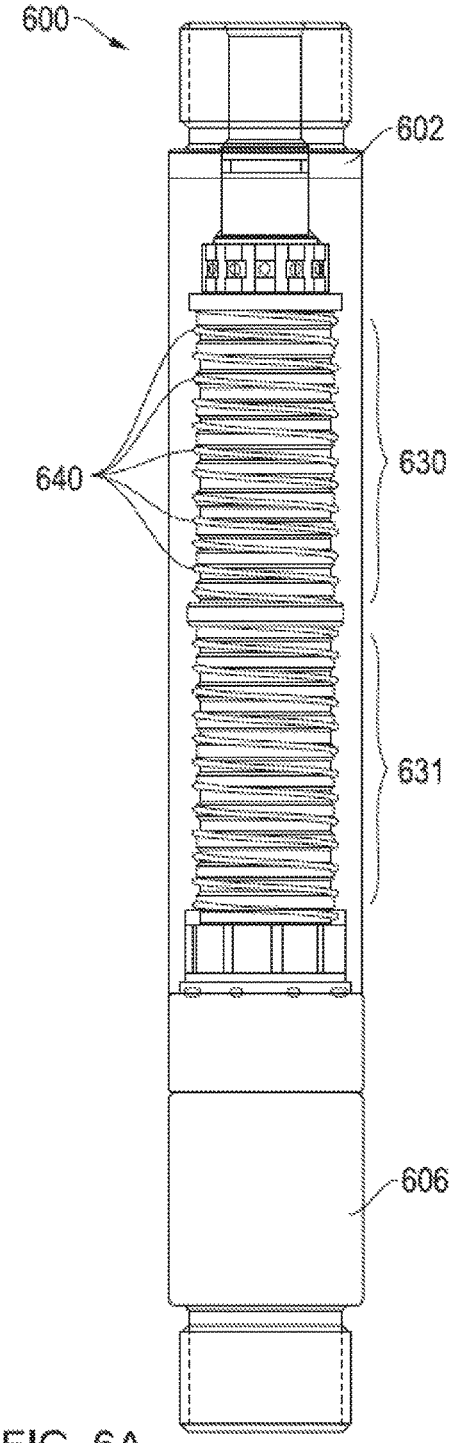
FIG. 6A is a side view of another embodiment of a fully assembled gap sub in which the housing is shown as transparent.
Figure 6B:
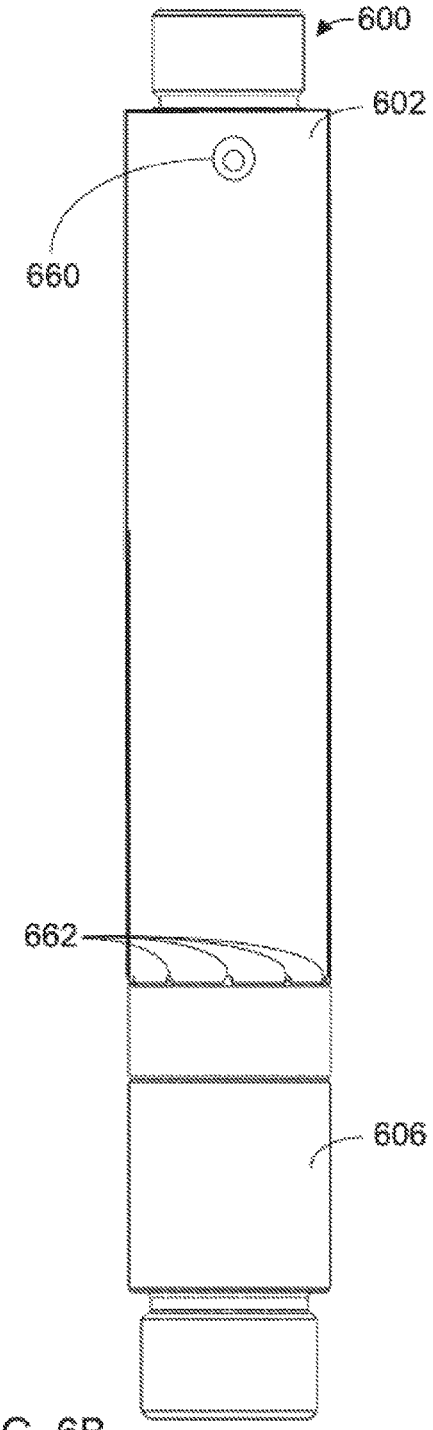
FIG. 6B is a side view of another embodiment of a fully assembled gap sub in which the housing is not transparent.

FIGS. 6A and 6B are side views of another embodiment of a fully assembled gap sub 600. In FIG. 6A, the housing 606 is transparent in order to illustrate the helical grooves on the connecting surfaces of the housing 606 and mandrel 602. As shown by FIG. 6A, the gap sub has right-handed helical grooves 640 and left-handed helical grooves 641 formed in separate sections of the connecting surfaces of both the housing and mandrel (sections 630 and 631, respectively).

Figure 7:
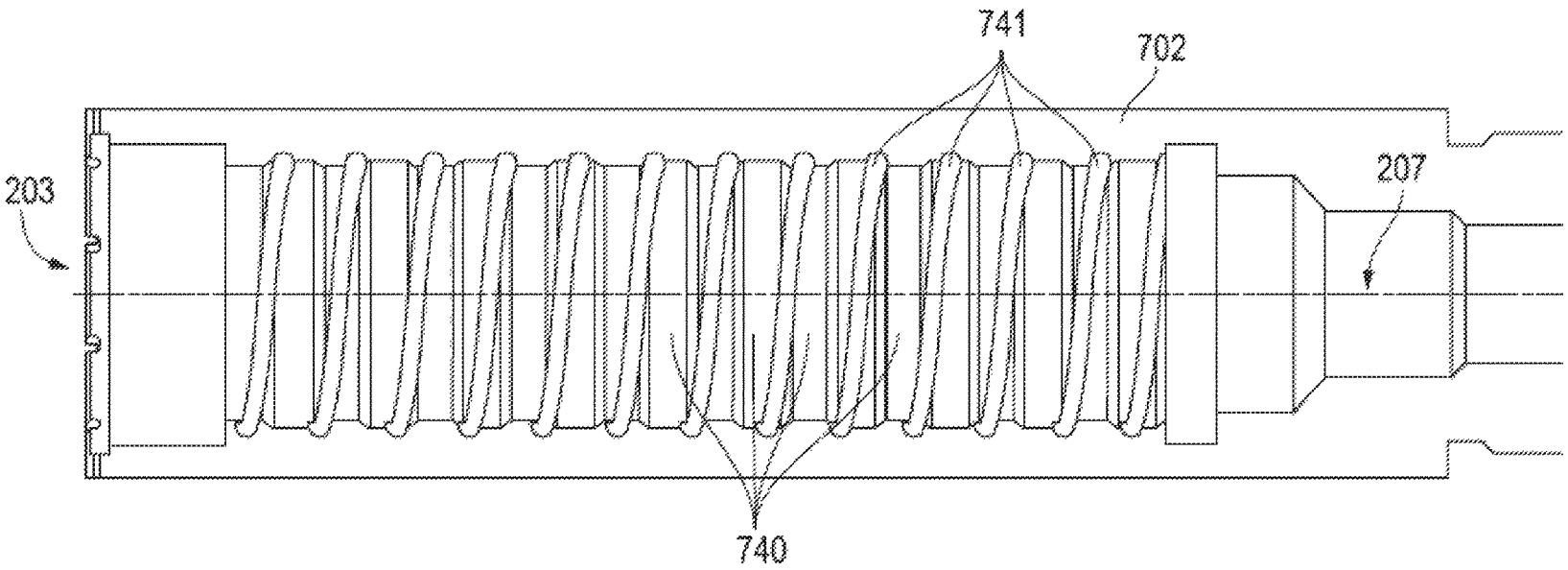
FIG. 7 is a side view of another embodiment of a gap sub housing according to embodiments of the present invention in which the outer surface of the housing is shown as transparent.

In the embodiments of FIGS. 5 to 6, the right-handed grooves and the left-handed grooves are found in separate sections of the connecting surfaces. In other embodiments, however, the right- and left-handed grooves can both be found in the same section of the connecting surfaces, with one set of grooves overlaying or superimposed upon the other set of grooves. A housing 702 of such an embodiment is illustrated in FIG. 7. This combination of right-handed grooves 740 and left-handed grooves 741 in the same section of the connecting surfaces is desirable because it saves length (allows for a shorter gap sub).

In the embodiments shown in FIGS. 5 to 6, there are about four right- and left-handed helical grooves per inch, although other suitable densities of grooves or threads can be used. For example, in some embodiments the grooves on the housing and mandrel surfaces have a pitch of about 2 to about 10 grooves per inch, about 4 to about 6 grooves per inch, or about 4 grooves per inch. In particular embodiments, the grooves are in the form of typical right and/or left handed stub acme threads, where the "threads" are non-overlapping.

When the space between the gap sub components is filled with an epoxy or other electrically insulating material, the arrangement and orientation of the grooves forms a complex 3D shear resistance mechanism, which is preferably optimized to resist torsion or twisting.

Figure 8:
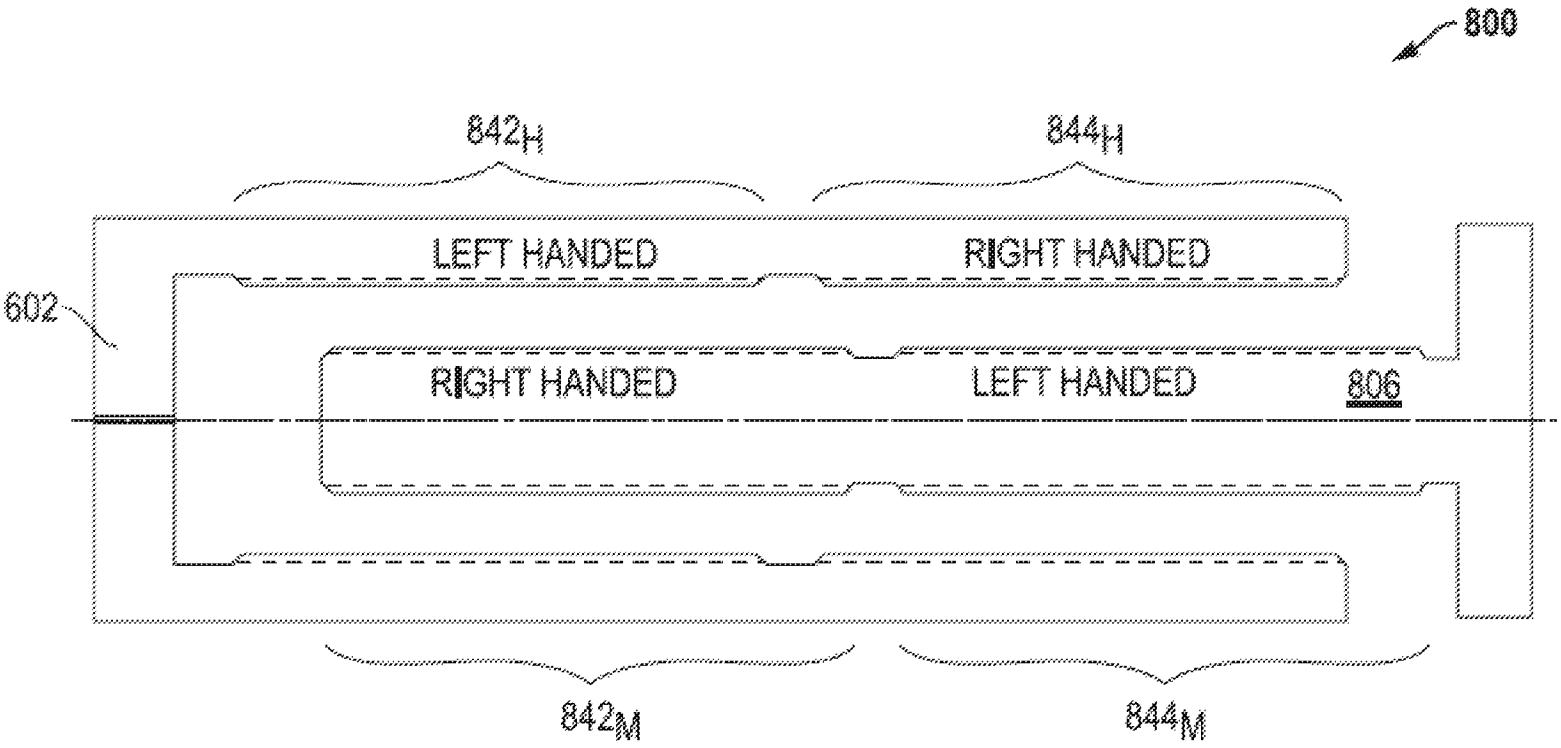
FIG. 8 shows a schematic drawing of another embodiment of a gap sub according to the present invention.

Although the grooves shown in FIGS. 5 to 6 show a series of continuous loops (similar to a thread formed on a typical threaded fastener such as a screw or bolt), the grooves could be put together in virtually any orientation and still achieve the desired effects described herein. For example, FIG. 8 shows a schematic drawing of an embodiment where left-handed grooves are formed on the inner surface of the housing in one section $\mathbf{842}_H$ of the connecting portion of the housing, while right-handed grooves are formed on the corresponding outer surface of the mandrel (section $\mathbf{842}_M$). In another section $\mathbf{844}_H$ of the connecting portion of the housing, right-handed grooves are formed while left-handed grooves are formed on the corresponding connecting portion of the mandrel (section $\mathbf{844}_M$). Any combination of connecting surfaces could be used. For example, in some embodiments both sections of the housing can have right-handed grooves while both sections of the mandrel have left-handed grooves, or both sections of the housing could have left-handed grooves and both sections of the mandrel have right-handed grooves. In other embodiments, a portion of the housing could have right-handed grooves while the corresponding portion of the mandrel has left-handed grooves, or vice versa. In these embodiments, although the grooves in the corresponding sections of the housing and mandrel are reversed, when an epoxy or other insulating material is applied between the housing and mandrel in the embodiment of FIG. 8, the resulting hardened bonding material will still have a 3D shape that requires shearing of the bonding material in order to twist the housing and mandrel relative to each other.

In particular embodiments, the staggered sections and the right- and left-handed helical grooves are designed to optimize the strength of epoxy (or other electrically isolating material), which is general much greater in resistance to shear than to delamination from the bonded components. Thus, the features on the connecting portions of the upper and lower components are designed so that once epoxy is added to the fill space and cured, any axial or rotational movement by the components relative to one another will require the shearing of the cured epoxy or other electrically isolating material.

In particular embodiments, the housing and mandrel slide together using purely axial force, in other words without any rotation or threading together of the components. Thus, the connecting surfaces of the housing and mandrel do not make contact as the mandrel is inserted into the housing. Although the right- and left-handed helical grooves formed in the connecting surfaces of the housing and mandrel appear to be threads, in some embodiments there is no overlap of the grooves themselves and so no true threading behavior. This allows the components to be very easily joined together (with no turning or rotation) while still maintaining very high mechanical strength since either axial or torsional movement of the mandrel with respect to the housing will require shearing of the epoxy (which requires much more force that delamination of the epoxy from a metal surface). In particular embodiments, the connection between the gap sub components will be able to withstand a torsional load of at least about 10,000 lb-ft, at least about 16,000 lb-ft, at least about 20,000 lb-ft, at least about 23,000 lb-ft, or even at least about 30,000 lb-ft without failure.

In some embodiments, no "clocking" is required. "Clocking" as used herein refers to rotation of one component relative to the other until a certain rotational geometry is achieved. This also serves to greatly simplify assembly of the gap sub. For example, in the embodiment shown in FIGS. 2A to 2C, the central portion 221 of the connecting portions of the mandrel and housing has typical overlapping/engaging threads. In such embodiments, once the mandrel is threaded into the housing, clocking will be required to set a consistent gap between the overlapping threads so they are not in contact. In the embodiments shown in FIGS. 3A to 8, however, no clocking is required because the connection features are non-overlapping.

Once the components have been connected together, non-conductive bearings can be used to hold the housing and mandrel in position relative to each other. Inlet and outlet fill ports can be used to circulate an electrically isolating (nonconductive) material through the void (gap) between the housing and mandrel. For example, FIG. 6B shows inlet fill port 660 on the exterior surface of housing 602 for circulating the electrically isolating material. Port 660 can also be connected to vacuum before adding the electrically isolating material in order to remove air from the gap between housing and mandrel in the assembled gap sub. Through holes 662 can be arranged circumferentially around the housing to allow any remaining air to be expelled so the electrically isolating material can completely fill the dielectric gap. In some embodiments, the fill port is plugged with a high-pressure plug after the uncured electrically isolating medium is added to the space between the connecting portions of the housing and the mandrel. In other embodiments, one or more ports may be left unplugged to allow the epoxy or other electrically isolating material to vent or bleed as it cures.

In particular embodiments, a one or two part nonconductive epoxy is used. The electrically isolating material can comprise a dielectric epoxy and/or a thermally curing epoxy. In some embodiments, a two-part epoxy that cures at room temperature and pressure could be used. For example, suitable electrically isolating materials could include an epoxy such as ES550 or ES562 available commercially from PERMABOND or EP950 available commercially from RESINLAB. In addition to epoxies, other suitable nonconductive materials could be used including, as a nonlimiting example, injected plastic. In some embodiments, a fluid electrically isolating material could be pumped into the space or gap between the housing and mandrel, for example at a pressure of 500 psi to 2000 psi. Preferably, the electrically isolating material will cure to form a solid layer of nonconductive material that is also mechanically strong enough to hold the gap sub components together when exposed to the rigors of directional drilling.

Figure 9:
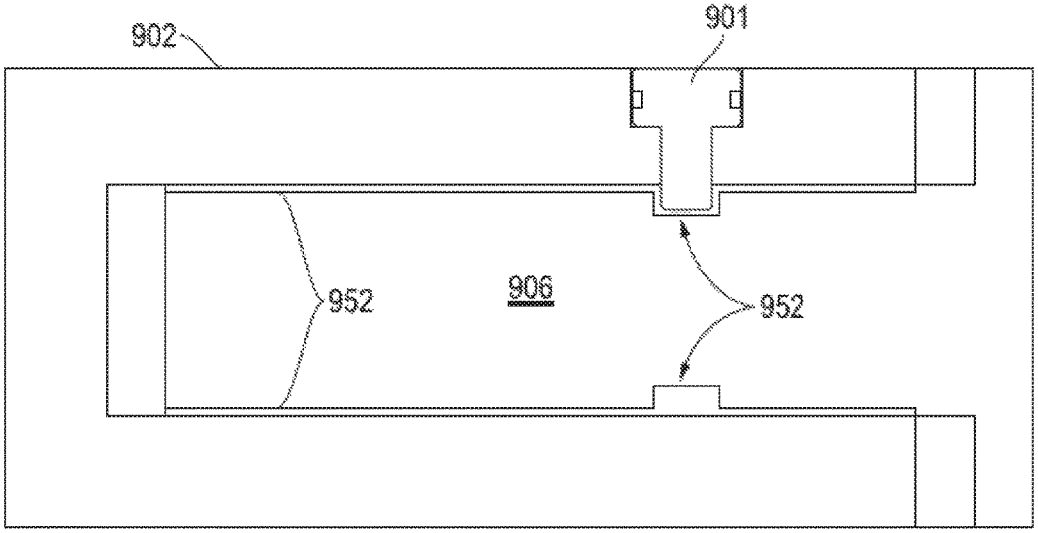
FIG. 9 shows an embodiment of the present invention in which a sealed bolt is used as a fail-safe device to hold the gap sub components together in the event of a complete bonding material failure.

Particular embodiments of the present invention could also make use of a bolt or pin as a fail safe measure in the event of a complete failure of the epoxy or other bonding material. For example, FIG. 9 shows an embodiment of the present invention in which a sealed bolt 901 is used as a fail-safe device. Sealed bolt 901 can be threaded through the housing 906 after the two components (housing and mandrel) slide together. Bolt can pass through the gap 950 between the housing 902 and mandrel 906 and loosely catch a machine groove 952 on the mandrel body. Preferably, the gap and machine groove are filled with a bonding material, which is then cured, holding the bolt solidly in place. Because the bolt is only loosely caught by the machined groove on the mandrel, the cured bonding material will form a layer between the bolt and the mandrel to keep the bolt electrically isolated from the mandrel. In case of a complete bonding material/epoxy failure, the bolt traps the mandrel in the housing and holds the two components together, which allows the gap sub and the downhole components to be recovered from the borehole.

The present invention has broad applicability and can provide many benefits as described and shown in the examples above. The embodiments will vary greatly depending upon the specific application, and not every embodiment will provide all of the benefits and meet all of the objectives that are achievable by the invention. Note that not all of the activities described above in the general description or the examples are required, that a portion of a specific activity may not be required, and that one or more further activities may be performed in addition to those described. Still further, the order in which activities are listed are not necessarily the order in which they are performed.

Embodiments of the present invention generally provide a method and an apparatus for use in an EM telemetry system. For ease of explanation, the invention will be described generally in relation to drilling directional wells, but it should be understood, however, that the method and the apparatus are equally applicable in other telemetry applications. Furthermore, it should be noted that some embodiments of the present invention can be used not only during drilling, but throughout the life of a wellbore such as during logging, testing, completing, and producing the well.

In the foregoing specification, the concepts have been described with reference to specific embodiments. However, one of ordinary skill in the art appreciates that various modifications and changes can be made without departing from the scope of the invention as set forth in the claims below. Accordingly, the specification and figures are to be regarded in an illustrative rather than a restrictive sense, and all such modifications are intended to be included within the scope of invention. After reading the specification, skilled artisans will appreciate that certain features are, for clarity, described herein in the context of separate embodiments, may also be provided in combination in a single embodiment. Conversely, various features that are, for brevity, described in the context of a single embodiment, may also be provided separately or in any subcombination. Further, references to values stated in ranges include each and every value within that range.

Item 1. A gap sub assembly comprising:

a generally cylindrical housing having an interior connecting surface including right- and left-handed helical grooves;

a generally cylindrical mandrel having an outer connecting surface inserted into the housing to form a gap between the interior surface of the housing and the outer surface of the mandrel, the outer connecting surface including right- and left-handed helical grooves;

an electrically isolating medium filling the gap between the housing and the mandrel, the electrically isolating medium mechanically coupling the housing and the mandrel while maintaining electrical isolation between the housing and the mandrel;

wherein the right-handed and left-handed grooves on the housing and mandrel surfaces have clearing diameters so that the mandrel can be inserted into the housing without any longitudinal rotation of the mandrel relative to the housing.

Item 2. A gap sub assembly comprising:

a generally cylindrical housing having an interior connecting surface;

a generally cylindrical mandrel having an outer connecting surface inserted into the housing to form a gap between the interior surface of the housing and the outer surface of the mandrel; and an electrically isolating medium filling the gap between the housing and the mandrel, the electrically isolating medium mechanically coupling the housing and the mandrel while maintaining electrical isolation between the housing and the mandrel;

wherein the interior connecting surface of the housing includes:

a region comprising a plurality of axial sections having a staggered internal diameter in which at least one axial section having a first internal diameter is adjacent to axial sections on either side which have larger internal diameters;

a region having right-handed helical grooves formed on the interior surface and/or a region having left-handed helical grooves formed on the interior surface;

wherein the outer surface of the connecting portion of the mandrel includes:

a region comprising a plurality of axial sections having a staggered diameter in which at least one axial section having a first diameter is adjacent to axial sections on either side which have smaller diameters;

a region having right-handed helical grooves formed on the outer surface and/or a region having left-handed helical grooves formed on the outer surface; and wherein when the plurality of mandrel axial sections are matched with corresponding axial sections of the housing so that the space between the housing and mandrel is generally the same across all of the axial sections, and wherein the right-handed and left-handed grooves on the housing and mandrel surfaces do not overlap when the housing and mandrel are connected.

Item 3. The gap sub assembly of item 2 wherein, when the housing and mandrel are connected, the region having right-handed helical grooves formed on the outer surface of the mandrel corresponds to the right-handed helical grooves formed on the interior surface of the housing and/or the region having left-handed helical grooves formed on the outer surface of the mandrel corresponds to the left-handed helical grooves formed on the interior surface of the housing.

Item 4. A gap sub assembly comprising:

a cylindrical housing having an open end and a connecting portion proximal to the open end; a cylindrical mandrel having a connecting portion at one end inserted into the connecting portion of the cylindrical housing, wherein a generally uniform space is formed between the interior surface of the connecting portion of the housing and the outer surface of the connecting portion of the mandrel so that there is no electrically connective contact between the housing and the mandrel; and an electrically isolating medium within the generally uniform space between the connecting portions of the housing and the mandrel, the electrically isolating medium mechanically coupling the housing and the mandrel while maintaining electrical isolation between the housing and the mandrel;

wherein the interior surface of the connecting portion of the housing includes:

a region comprising a plurality of axial sections having a staggered internal diameter in which at least one axial section having a first internal diameter is adjacent to axial sections on either side which have larger internal diameters;

a region having right-handed helical grooves formed on the interior surface; and a region having left-handed helical grooves formed on the interior surface;

wherein the outer surface of the connecting portion of the mandrel includes:

a region comprising a plurality of axial sections having a staggered diameter in which at least one axial section having a first diameter is adjacent to axial sections on either side which have smaller diameters, the plurality of mandrel axial sections matched with corresponding axial sections of the housing so that the space between the housing and mandrel is generally the same across all of the axial sections;

a region having right-handed helical grooves formed on the outer surface that corresponds to the right-handed helical grooves formed on the interior surface of the housing; and a region having left-handed helical grooves formed on the outer surface that corresponds to the region having left-handed helical grooves formed on the interior surface of the housing; and wherein the right-handed and left-handed grooves on the housing and mandrel surfaces do not overlap when the housing and mandrel are connected.

Item 5. An electrically insulating gap sub for use with an EM telemetry system, the gap sub comprising:

a cylindrical housing having an open end and a connecting portion proximal to the open end;

a cylindrical mandrel having a connecting portion at one end, wherein the cylindrical housing is configured to receive the connecting portion of the cylindrical mandrel, and wherein the mandrel is sized so that the connecting portion of the mandrel can be axially inserted into the interior of a connecting portion of the cylindrical housing to form a generally uniform space between the interior surface of the connecting portion of the housing and the outer surface of the connecting portion of the mandrel; and a curable electrically isolating medium to be injected within the generally uniform space between the connecting portions of the housing and the mandrel, the cured electrically isolating medium mechanically coupling the housing and the mandrel while maintaining electrical isolation between the housing and the mandrel;

wherein the gap sub assembly includes at least one of the following:

an axial force resistance assembly in which the interior surface of the connecting portion of the housing includes a region comprising a plurality of axial sections having a staggered internal diameter and at least one axial section having a first internal diameter is adjacent to axial sections on either side that have larger internal diameters, the outer surface of the connecting portion of the mandrel includes a region comprising a plurality of axial sections having a staggered diameter and at least one axial section having a first diameter is adjacent to axial sections on either side which have smaller diameters, the plurality of mandrel axial sections matched with corresponding axial sections of the housing so that the space between the housing and mandrel is generally the same across all of the axial sections, and in which once the connecting portion of the mandrel is inserted into the connecting portion of the housing and the uniform space between the connecting portions of the housing and the mandrel is filled with the cured electrically isolating medium, the mandrel cannot be removed from the housing by way of an axial force without shearing through at least one layer of the cured electrically isolating medium; and a torsion resistance assembly in which an interior surface of the connecting portion of the housing includes a first region having right-handed helical grooves formed on the interior surface and a separate second region having left-handed helical grooves formed on the interior surface, an outer surface of the connecting portion of the mandrel includes a first region having right-handed helical grooves formed on the outer surface that corresponds to the right-handed helical grooves formed on the interior surface of the housing and a separate second region having left-handed helical grooves formed on the outer surface that corresponds to the region having left-handed helical grooves formed on the interior surface of the housing, and in which the right-handed and left-handed grooves on the housing and mandrel surfaces are non-overlapping when the housing and mandrel are connected.

Item 6. A gap sub assembly comprising:

a generally cylindrical housing having an open end and a connecting portion proximal to the open end;

a generally cylindrical mandrel having a connecting portion at one end axially inserted into the interior of the connecting portion of the housing to form a gap between the interior surface of the connecting portion of the housing and the outer surface of the connecting portion of the mandrel; and an electrically isolating medium filling the gap between the connecting portions of the housing and the mandrel, the electrically isolating medium mechanically coupling the housing and the mandrel while maintaining electrical isolation between the housing and the mandrel;

wherein the interior surface of the connecting portion of the housing includes a region comprising a plurality of axial sections having a staggered internal diameter in which at least one axial section having a first internal diameter is adjacent to axial sections on either side which have larger internal diameters and the outer surface of the connecting portion of the mandrel includes a region comprising a plurality of axial sections having a staggered diameter in which at least one axial section having a first diameter is adjacent to axial sections on either side which have smaller diameters, the plurality of mandrel axial sections matched with corresponding axial sections of the housing so that the space between the housing and mandrel is generally the same across all of the axial sections; and wherein the mandrel cannot be removed from the housing by way of an axial force without shearing through at least one layer of the cured electrically isolating medium.

Item 7. The gap sub assembly of item 6 further comprising:

an interior surface of the connecting portion of the housing including a region having right-handed helical grooves formed on the interior surface and a region having left-handed helical grooves formed on the interior surface;

an outer surface of the connecting portion of the mandrel including a region having right-handed helical grooves formed on the outer surface and/or a region having left-handed helical grooves formed on the outer surface;

wherein the right-handed and/or left-handed grooves on the housing and mandrel surfaces do not overlap when the housing and mandrel are connected.

Item 8. The gap sub assembly of item 7 in which right-handed helical grooves are formed on the portion of the outer surface of the connecting portion of the mandrel that corresponds to the right-handed helical grooves formed on the interior surface of the housing and/or in which left-handed helical grooves are formed on the portion of the outer surface of the connecting portion of the mandrel that corresponds to the left-handed helical grooves formed on the interior surface of the housing.

Item 9. The gap sub assembly of item 7 in which right-handed helical grooves are formed on the portion of the outer surface of the connecting portion of the mandrel that corresponds to the left-handed helical grooves formed on the interior surface of the housing and/or in which left-handed helical grooves are formed on the portion of the outer surface of the connecting portion of the mandrel that corresponds to the right-handed helical grooves formed on the interior surface of the housing.

Item 10. Any one of the preceding items in which the end of the housing distal to the mandrel has an end connection adapted for connecting the housing to a drill string.

Item 11. Any one of the preceding items in which the end of the mandrel distal to the housing has an end connection adapted for connecting the mandrel to a drill string.

Item 12. Any one of the preceding items in which the housing and the mandrel each have an internal flow bore such that when the mandrel is inserted into the housing, a continuous longitudinal flow bore is formed so that when the assembled gap sub is connected into a drill string, fluid can flow from the upper portion of the drill sting through the gap sub and into the lower portion of the drill string.

Item 13. Any one of the preceding items in which the corresponding right and left handed grooves on the housing and mandrel surfaces have the same pitch and size.

Item 14. Any one of the preceding items in which the corresponding right and left handed grooves on the housing and mandrel surfaces have a pitch of about 2 to about 10 grooves per inch, about 4 to about 6 grooves per inch, or about 4 grooves per inch.

Item 15. Any one of the preceding items in which the corresponding right and left handed grooves on the housing and mandrel surfaces have clearing diameters.

Item 16. Any one of the preceding items in which corresponding right-handed grooves on the housing and mandrel surfaces together form a helical right-handed void between the housing and mandrel surfaces.

Item 17. Any one of the preceding items in which corresponding left-handed grooves on the housing and mandrel surfaces together form a helical left-handed void between the housing and mandrel surfaces.

Item 18. Any one of the preceding items in which corresponding right-handed grooves on the housing and mandrel surfaces together form a helical right-handed void between the housing and mandrel surfaces, while corresponding left-handed grooves on the housing and mandrel surfaces together form a helical left-handed void between the housing and mandrel surfaces, the right and left handed helical voids having the same pitch.

Item 19. Any one of the preceding items in which the interior surface of the connecting portion of the housing and the outer surface of the connecting portion of the mandrel are complimentary.

Item 20. Any one of the preceding items in which the interior surface of the connecting portion of the housing and the outer surface of the connecting portion of the mandrel have diameters that alternate in size by a fixed value for a specified length.

Item 21. Any one of the preceding items in which the interior surface of the connecting portion of the housing and the outer surface of the connecting portion of the mandrel are sized such that the connecting portion of the mandrel can slide axially inside the connecting portion of the housing without any longitudinal rotation of the mandrel relative to the housing.

Item 22. Any one of the preceding items in which the electrically isolating medium comprises a dielectric epoxy.

Item 23. Any one of the preceding items in which the electrically isolating medium comprises a thermally curing epoxy.

Item 24. Any one of the preceding items in which the electrically isolating medium is injected into the dielectric gap at a pressure of at least about 500 psi to 2000 psi.

Item 25. Any one of the preceding items in which the connected housing and mandrel are held in position radially by at least one non-conductive bearing.

Item 26. Any one of the preceding items in which the generally uniform space between the connecting portions of the housing and the mandrel is filled with uncured electrically isolating medium under pressure, which is then cured to mechanically couple the housing and the mandrel while maintaining electrical isolation between the housing and the mandrel.

Item 27. Any one of the preceding items further comprising fill ports in the housing to allow for fluid circulation through the space between the connecting portions of the housing and the mandrel.

Item 28. The gap sub assembly of item 27 in which the fill ports are plugged with high-pressure plugs after the uncured electrically isolating medium is added to the space between the connecting portions of the housing and the mandrel.

Item 29. Any one of the preceding items in which the shape of a portion of the cured electrically isolating medium results in a resistance to both right-handed and left-handed torsion of at least about 10,000 lb-ft, at least about 16,000 lb-ft, at least about 20,000 lb-ft, at least about 23,000 lb-ft, at least about 30,000 lb-ft, at least about 40,000 lb-ft, at least about 60,000 lb-ft, or even at least about 80,000 lb-ft without failure.

Item 30. Any one of the preceding items in which the shape of a portion of the cured electrically isolating medium results in a resistance to axial strain of at least 900,000 pounds without failure.

Item 31. Any one of the preceding items in which:

the housing has an internal shoulder distal to the open end of the housing configured to receive the connecting portion of the mandrel;

the mandrel has an external shoulder distal to the end of the mandrel having a connecting portion;

wherein the mandrel and the housing are connected together by inserting the connecting portion of the mandrel into the open end of the housing configured to receive the connecting portion of the mandrel until the shoulders of the housing and mandrel prevent further insertion.

Item 32. The gap sub assembly of item 31 further comprising dielectric spacers between the shoulders of the housing and mandrel to prevent electrical continuity between the shoulders when the housing and mandrel are connected.

Item 33. The gap sub assembly of item 32 in which the spacers are sealed to the housing and mandrel via O-rings.

Item 34. Any one of the preceding items in which the right and left handed grooves comprise non-overlapping right and left handed stub acme threads.

Item 35. Any one of the preceding items further comprising at least one supplementary connector to prevent the housing and mandrel from separating in the event of failure of the electrically isolating medium.

As used herein, the terms "comprises," "comprising," "includes," "including," "has," "having" or any other variation thereof, are intended to cover a non-exclusive inclusion. For example, a process, method, article, or apparatus that comprises a list of features is not necessarily limited only to those features but may include other features not expressly listed or inherent to such process, method, article, or apparatus. Further, unless expressly stated to the contrary, "or" refers to an inclusive-or and not to an exclusive-or. For example, a condition A or B is satisfied by any one of the following: A is true (or present) and B is false (or not present), A is false (or not present) and B is true (or present), and both A and B are true (or present). Also, the use of "a" or "an" are employed to describe elements and components described herein. This is done merely for convenience and to give a general sense of the scope of the invention. This description should be read to include one or at least one and the singular also includes the plural unless it is obvious that it is meant otherwise.

Benefits, other advantages, and solutions to problems have been described above with regard to specific embodiments. However, the benefits, advantages, solutions to problems, and any feature(s) that may cause any benefit, advantage, or solution to occur or become more pronounced are not to be construed as a critical, required, or essential feature of any or all the claims.

Although the present invention and its advantages have been described in detail, it should be understood that various changes, substitutions and alterations can be made to the embodiments described herein without departing from the spirit and scope of the invention as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the disclosure of the present invention, processes, machines, manufacture, compositions of matter, means, methods, or steps, presently existing or later to be developed that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps.

We claim as follows:

1. A gap sub assembly comprising:

a generally cylindrical housing having an interior connecting surface including right- and left-handed helical grooves;

a generally cylindrical mandrel having an outer connecting surface inserted into the housing to form a gap between the interior surface of the housing and the outer surface of the mandrel, the outer connecting surface including right- and left-handed helical grooves;

an electrically isolating medium filling the gap between the housing and the mandrel, the electrically isolating medium mechanically coupling the housing and the mandrel while maintaining electrical isolation between the housing and the mandrel;

wherein the right-handed and left-handed grooves on the housing and mandrel surfaces have clearing diameters so that the mandrel can be inserted into the housing without any longitudinal rotation of the mandrel relative to the housing, and wherein, when the housing and mandrel are connected, the region having right-handed helical grooves formed on the outer surface of the mandrel corresponds to the left-handed helical grooves formed on the interior surface of the housing and/or the region having left-handed helical grooves formed on the outer surface of the mandrel corresponds to the right-handed helical grooves formed on the interior surface of the housing.

2. The gap sub assembly of claim 1 in which the end of the housing distal to the mandrel and/or the end of the mandrel distal to the housing has an end connection adapted for connecting to a drill string.

3. The gap sub assembly of claim 1 in which the housing and the mandrel each have an internal flow bore such that when the mandrel is inserted into the housing, a continuous longitudinal flow bore is formed so that when the assembled gap sub is connected into a drill string, fluid can flow from the upper portion of the drill sting through the gap sub and into the lower portion of the drill string.

4. The gap sub assembly of claim 1 in which the corresponding right and left handed grooves on the housing and mandrel surfaces have the same pitch and size.

5. The gap sub assembly of claim 1 in which the electrically isolating medium comprises a dielectric epoxy.

6. The gap sub assembly of claim 1 in which the electrically isolating medium comprises a thermally curing epoxy.

7. A gap sub assembly comprising:

a generally cylindrical housing having an interior connecting surface including right- and left-handed helical grooves;

a generally cylindrical mandrel having an outer connecting surface inserted into the housing to form a gap between the interior surface of the housing and the outer surface of the mandrel, the outer connecting surface including right- and left-handed helical grooves;

an electrically isolating medium filling the gap between the housing and the mandrel, the electrically isolating medium mechanically coupling the housing and the mandrel while maintaining electrical isolation between the housing and the mandrel;

wherein the right-handed and the left-handed grooves on the housing and mandrel surfaces have clearing diameters so that the mandrel can be inserted into the housing without any longitudinal rotation of the mandrel relative to the housing, and wherein the interior surface of the connecting portion of the housing includes a region comprising a plurality of axial sections having a staggered internal diameter in which at least one axial section having a first internal diameter is adjacent to axial sections on either side which have larger internal diameters and the outer surface of the connecting portion of the mandrel includes a region comprising a plurality of axial sections having a staggered diameter in which at least one axial section having a first diameter is adjacent to axial sections on either side which have smaller diameters, the plurality of mandrel axial sections matched with corresponding axial sections of the housing so that the space between the housing and mandrel is generally the same across all of the axial sections; and wherein the mandrel cannot be removed from the housing by way of an axial force without shearing through at least one layer of the electrically isolating medium.

8. The gap sub assembly of claim 7 in which the end of the housing distal to the mandrel and/or the end of the mandrel distal to the housing has an end connection adapted for connecting to a drill string.

9. The gap sub assembly of claim 7 in which the housing and the mandrel each have an internal flow bore such that when the mandrel is inserted into the housing, a continuous longitudinal flow bore is formed so that when the assembled gap sub is connected into a drill string, fluid can flow from the upper portion of the drill sting through the gap sub and into the lower portion of the drill string.

10. The gap sub assembly of claim 7 in which the corresponding right and left handed grooves on the housing and mandrel surfaces have the same pitch and size.

11. The gap sub assembly of claim 7 in which the electrically isolating medium comprises a dielectric epoxy.

12. The gap sub assembly of claim 7 in which the electrically isolating medium comprises a thermally curing epoxy.

13. An electrically insulating gap sub for use with an EM telemetry system, the gap sub comprising:

a cylindrical housing having an open end and a connecting portion proximal to the open end;

a cylindrical mandrel having a connecting portion at one end, wherein the cylindrical housing is configured to receive the connecting portion of the cylindrical mandrel, and wherein the mandrel is sized so that the connecting portion of the mandrel can be axially inserted into the interior of a connecting portion of the cylindrical housing to form a generally uniform space between the interior surface of the connecting portion of the housing and the outer surface of the connecting portion of the mandrel; and a curable electrically isolating medium to be injected within the generally uniform space between the connecting portions of the housing and the mandrel, the cured electrically isolating medium mechanically coupling the housing and the mandrel while maintaining electrical isolation between the housing and the mandrel;

wherein the gap sub assembly includes at least one of the following:

a) an axial force resistance assembly in which the interior surface of the connecting portion of the housing includes a region comprising a plurality of axial sections having a staggered internal diameter and at least one axial section having a first internal diameter is adjacent to axial sections on either side that have larger internal diameters, the outer surface of the connecting portion of the mandrel includes a region comprising a plurality of axial sections having a staggered diameter and at least one axial section having a first diameter is adjacent to axial sections on either side which have smaller diameters, the plurality of mandrel axial sections matched with corresponding axial sections of the housing so that the space between the housing and mandrel is generally the same across all of the axial sections; and b) a torsion resistance assembly in which an interior surface of the connecting portion of the housing includes a first region having right-handed helical grooves formed on the interior surface and a separate second region having left-handed helical grooves formed on the interior surface, an outer surface of the connecting portion of the mandrel includes a first region having right-handed helical grooves formed on the outer surface and a separate second region having left-handed helical grooves formed on the outer surface;

wherein the interior surface of the housing and the exterior surface of the mandrel do not overlap when the housing and mandrel are connected so that the mandrel can be inserted into the housing without any longitudinal rotation of the mandrel relative to the housing.

14. The gap sub assembly of claim 13 in which the uncured electrically isolating medium is injected into the generally uniform space between the connecting portions of the housing and the mandrel and then cured to mechanically couple the housing and the mandrel while maintaining electrical isolation between the housing and the mandrel.

15. The gap sub assembly of claim 14 in which the uncured electrically isolating medium is injected into the generally uniform space between the connecting portions of the housing and the mandrel at a pressure of at least about 500 psi to 2000 psi.

16. The gap sub assembly of claim 13 including said axial force resistance assembly in which, once the connecting portion of the mandrel is inserted into the connecting portion of the housing and the uniform space between the connecting portions of the housing and the mandrel is filled with the cured electrically isolating medium, the mandrel cannot be removed from the housing by way of an axial force without shearing through at least one layer of the cured electrically isolating medium.

17. The gap sub assembly of claim 16 having a resistance to axial strain of at least 900,000 pounds without failure.

18. The gap sub assembly of claim 13 including said torsion resistance assembly and having a resistance to both right-handed and left-handed torsion of at least about 10,000 lb-ft without failure.

19. The gap sub assembly of claim 13 which:

the housing has an internal shoulder distal to the open end of the housing configured to receive the connecting portion of the mandrel;

the mandrel has an external shoulder distal to the end of the mandrel having a connecting portion;

wherein the mandrel and the housing are connected together by inserting the connecting portion of the mandrel into the open end of the housing configured to receive the connecting portion of the mandrel until the shoulders of the housing and mandrel prevent further insertion.

20. The gap sub assembly of claim 13 further comprising at least one supplementary connector to prevent the housing and mandrel from separating in the event of failure of the electrically isolating medium.

* * * * *